US005968714A

United States Patent [19]

Leenders et al.

[11] Patent Number: 5,968,714

[45] Date of Patent: Oct. 19, 1999

[54] SENSITIVITY-INCREASING RECORDING PROCESS FOR A PHOTOSENSITIVE THERMALLY DEVELOPABLE PHOTOGRAPHIC MATERIAL

[75] Inventors: Luc Leenders, Herentals; Jacobus Bosschaerts; Robert Overmeer, both of Mortsel; Eddie Daems, Herentals; Leo Oelbrandt, Kruibeke; Hans Strijckers, Oudergem, all of Belgium; Thomas Zehetmaier, Neufarn, Germany; Jürgen Müller; Friedrich Stumpf, both of München, Germany; Gerald Halbedl, Ebersbach, Germany

[73] Assignee: Agfa-Gevaert, Mortsel, Belgium

[21] Appl. No.: 08/924,523

[22] Filed: Sep. 5, 1997

Related U.S. Application Data

[63] Continuation-in-part of application No. 08/812,450, Mar. 6, 1997, Pat. No. 5,804,355

[60] Provisional application No. 60/015,678, Apr. 17, 1996.

[30] Foreign Application Priority Data

| | | | |
|---|---|---|---|
| Mar. 14, 1996 | [EP] | European Pat. Off. | 96200689 |
| Sep. 6, 1996 | [DE] | Germany | 196 36 235 |

[51] Int. Cl.[6] ..... G03C 5/26; G03C 5/29

[52] U.S. Cl. ..... 430/346; 430/348; 430/349; 430/203; 430/394; 430/494

[58] Field of Search ..... 430/349, 348, 430/353, 203, 394, 494, 346

[56] References Cited

U.S. PATENT DOCUMENTS

| | | | |
|---|---|---|---|
| 3,764,329 | 10/1973 | Lee et al. | 430/349 |
| 3,816,132 | 6/1974 | Takegawa et al. | 430/349 |
| 4,332,889 | 6/1982 | Siga et al. | 430/349 |
| 4,383,261 | 5/1983 | Goldberg | 430/346 |
| 4,820,622 | 4/1989 | Hirai | 430/203 |
| 4,857,439 | 8/1989 | Dedio et al. | 430/349 |
| 4,868,097 | 9/1989 | Aotsuka et al. | 430/203 |
| 5,116,716 | 5/1992 | Komamura et al. | 430/203 |
| 5,429,908 | 7/1995 | Hokuf et al. | 430/394 |
| 5,472,821 | 12/1995 | Taguchi | 430/203 |
| 5,556,740 | 9/1996 | Suzuki et al. | 430/203 |
| 5,627,007 | 5/1997 | Van den Bergh et al. | 430/494 |
| 5,773,189 | 6/1998 | Shibata | 430/203 |
| 5,804,355 | 9/1998 | Bosschaerts et al. | 430/349 |

*Primary Examiner*—Richard L. Schilling
*Attorney, Agent, or Firm*—Baker & Botts, L.L.P.

[57] ABSTRACT

A recording process comprising the steps of: information-wise exposing to radiation a photosensitive thermally developable photographic material, thereby producing a latent image; and heating the photosensitive thermally developable photographic material, characterized in that the photosensitive thermally developable photographic material is on one and the same holding or guiding means during both the information-wise exposure step and the heating step; and the information-wise exposure step is carried out during the heating step; and a method of increasing the photosensitivity of a photosensitive thermally developable photographic material.

13 Claims, No Drawings

SENSITIVITY-INCREASING RECORDING PROCESS FOR A PHOTOSENSITIVE THERMALLY DEVELOPABLE PHOTOGRAPHIC MATERIAL

This is a continuation-in-part application of the parent application, Ser. No. 08/812,450, filed Mar. 6, 1997 now U.S. Pat. No. 5,804,355. Also, this application claims the benefit of the U.S. Provisional Application No. 60/015,678, filed Apr. 17, 1996.

FIELD OF THE INVENTION

The present invention relates to a sensitivity-increasing recording process for photographic materials in which information-wise exposure is carried out during heating.

BACKGROUND OF THE INVENTION

Thermal imaging or thermography is a recording process wherein images are generated by the use of imagewise modulated thermal energy.

In thermography three approaches are known:

1. Image-wise or information-wise transfer of an ingredient necessary for the chemical or physical process bringing about changes in colour or optical density to a receptor element.

2. Thermal dye transfer printing wherein a visible image pattern is formed by transfer of a coloured species from an imagewise heated donor element onto a receptor element.

3. Direct thermal formation of a visible image pattern by image-wise or information-wise heating of a recording material containing matter that by chemical or physical process changes colour or optical density.

Thermographic materials of type 3 become photothermographic if a photosensitive agent is present which after exposure to UV, visible or IR light is capable of catalyzing or participating in a thermographic process bringing about changes in colour or optical density.

Examples of photothermographic materials are the so called "Dry Silver" photothermographic materials of the 3M Company, which are reviewed by D. A. Morgan in "Handbook of Imaging Science", edited by A. R. Diamond, page 43, published by Marcel Dekker in 1991.

DOS 2 248 545 discloses a copying process characterized in that the whole surface of a thermally developable photosensitive silver material is subjected before the complete execution of the exposure to a uniform auxiliary thermal treatment at a temperature, that is within the suitable development temperature range for the photosensitive material, and to thermal development after exposure; and that, in a subclaim, the photosensitive material can also be subjected to auxiliary heating during the exposure thereof. The specification and invention examples give no indication of the efficacity of auxiliary heating during exposure.

Yu. E. Usanov, T. B. Kolesova, L. P. Burleva, M. R. V. Sahyun and D. R. Whitcomb in the preprints of the Society for Imaging Science and Technology (I.S.& T.) 50th Annual Conference held at Cambridge, Mass., USA between the 18th and 23rd May 1997, pages 42 to 45 reported that: Experiments carried out with thermally developed Dry Silver™ type 7858 photothermographic materials from 3M and spectrally sensitized model photothermo-graphic materials showed that preheating at temperatures higher than 100° C. followed by cooling prior to flash lamp or sensitometer exposure results in decreased speed during development. Consequently, a decrease in the photosensitivity was observed. Analogous results were also obtained if the materials were exposed during the preheating process. The higher the pre-heating temperature above 100° C. and the longer the time of preheating, the lower the material photosensitivity. It was determined that this phenomenon depends neither on the composition of the silver halides nor on the method of incorporating them into the thermally developable composition.

It is desirable to increase the photosensitivity of photosensitive thermally developable photographic materials to be able to use less powerful heat sources. It is also desirable to achieve such an increase in photosensitivity, while enabling the simplification of photothermographic processing equipment, for example as disclosed in DE-A 196 36 253.0.

OBJECTS OF THE INVENTION

It is therefore an object of the present invention to provide a method of increasing the photosensitivity of photosensitive thermally developable photographic materials.

It is a further object of the present invention to provide an improved recording process enabling an increase in sensitivity, while enabling the use of simplified photothermographic processing equipment.

Other objects and advantages of the present invention will become clear from the further description and examples.

SUMMARY OF THE INVENTION

A recording process is provided comprising the steps of: information-wise exposing to radiation a photosensitive thermally developable photographic material, thereby producing a latent image; and heating the photosensitive thermally developable photographic material, characterized in that the photosensitive thermally developable photographic material is on one and the same holding or guiding means during both the information-wise exposure step and the heating step; and the information-wise exposure step is carried out during the heating step.

A method of increasing the photosensitivity of a photosensitive thermally developable photographic material is provided, characterized in that the photosensitive thermally developable photographic material is on one and the same holding or guiding means during both the information-wise exposure step and the heating step; the heating step is carried out before and/or during the information-wise exposure step.

Preferred embodiments of the present invention are disclosed in the detailed description of the invention.

DETAILED DESCRIPTION OF THE INVENTION

The inventors of the present invention surprisingly have found that the preheating of materials resulted in thermally developable photographic materials requiring shorter exposure times than with prior art processes in which unheated materials are exposed to recording radiation. This showed that materials upon heating are more sensitive to recording radiation and enables the apparatus to be simplified.

However, upon prolonged preheating the sensitivity to wavelengths to which the photosensitive thermally developable photographic materials had been spectrally sensitized is reduced and in the case of some materials destroyed altogether, in all cases the UV-photosensitivity, i.e. intrinsic photosensitivity, of the materials remaining substantially unchanged. This indicates an inability of the spectral sensitizer alone or together with a supersensitizer to sensitize the materials to IR-radiation after prolonged preheating, for whatever reason.

In a preferred embodiment, according to the present invention, the exposure step begins after the start of the heating step.

The photographic material may in a further step in the recording process and the method of increasing photosensitivity of a photographic material according to the present invention be preheated prior to exposure.

According to the present invention it is preferred that the duration of the exposure step be less than one tenth of the duration of the heating step and particularly preferred that the duration of the exposure step be less than one hundredth of the duration of the heating step.

In a particular embodiment of the present invention the information-wise exposure step and thermal development of the photosensitive thermally developable photographic material are carried out during the heating step, during which a visible image is produced from the latent image resulting from the exposure step.

In a particularly preferred embodiment of the present invention the heating step begins before the start of the exposure step and ends after thermal development to produce a visible image is complete.

Photographic materials and photosensitive thermally developable photographic materials may, according to the present invention, be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light. Exposure with infra-red light or visible light is preferred, visible light in the wavelength range 600 nm to 700 nm being particularly preferred. Exposure with an infra-red emitting laser diode is preferred, according to the present invention.

The photosensitive thermally developable photographic material may be heated during the exposure and the heating subsequent to the exposure by the same heating means. Furthermore, the photosensitive thermally developable photographic material may be heated prior to the exposure, during the exposure and during the heating subsequent to the exposure by the same heating means. A heated drum is a preferred common heating means.

For the thermal development of information-wise exposed photosensitive thermally developable photographic materials, according to the recording process of the present invention, any sort of heat source can be used that enables the recording materials to be uniformly heated to the development temperature in a time acceptable for the application concerned e.g. contact heating with for example a heated roller, a heated drum, a thermal head, radiative heating, microwave heating etc. The preferred temperature of the photosensitive thermally developable photographic material during thermal development is between 110° C. and 130° C.

In a preferred recording process, according to the present invention, at least two radiation beams move simultaneously over the photosensitive thermally developable photographic material the first of the radiation beams carrying out the information-wise exposing of the photosensitive thermally developable photographic material and the second of which heats the information-wise exposed photosensitive thermally developable photographic material to a uniform development temperature.

Photosensitive Thermally Developable Photographic Material

The photosensitive thermally developable photographic material preferably contains an infrared sensitizer or a visible light sensitizer and particularly preferably further contains photosensitive silver halide, an organic reducing agent and a binder. The use in the present invention of a photosensitive thermally developable photographic material including a gelatinous silver halide emulsion layer is preferred. The use in the present invention of a photosensitive thermally developable photographic material further containing a substantially light-insensitive organic silver salt with which the photosensitive silver halide in catalytic association and an organic reducing agent for the substantially light-insensitive organic silver salt in thermal working relationship therewith is particularly preferred. The photosensitive thermally developable photographic material may have a layer system in which the ingredients are dispersed in different layers, with the proviso that the image-forming process can take place.

For example, in the case of photosensitive thermally developable photographic materials containing photosensitive silver halide and an organic reducing agent optionally further containing a substantially light-insensitive organic silver salt, the photosensitive silver halide or substantially light-insensitive organic silver salt, if present, must be in thermal working relationship with the organic reducing agent i.e. during the thermal development process the reducing agent must be present in such a way that it is able to diffuse to the photosensitive silver halide or the substantially light-insensitive organic silver salt particles so that reduction of the silver halide or organic silver salt can take place; and the photosensitive silver halide is in catalytic association with the substantially light-insensitive organic silver salt, if present.

Photosensitive Silver Halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral Sensitizer

The photosensitive thermally developable photographic material, according to the present invention, may contain an infra-red sensitizer or a visible light sensitizer. Suitable sensitizers include cyanine, merocyanine, styryl, hemicyanine, oxonol, hemioxonol and xanthene dyes. Useful cyanine dyes include those having a basic nucleus, for example a thiazoline nucleus, an oxazoline nucleus, a pyrroline nucleus, a pyridine nucleus, an oxazole nucleus, a thiazole nucleus, a selenazole nucleus and an imidazole nucleus. Preferred merocyanine dyes include those having not only the above described basic nuclei but also acid nuclei, for example a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. Of the above described cyanine and merocyanine dyes, those having imino groups or carboxyl groups are particularly preferred.

Suitable infra-red sensitizers include those disclosed in EP-A's 465 078, 559 101, 616 014 and 635 756, JN's 03-080251, 03-163440, 05-019432, 05-072662 and 06-003763 and U.S. Pat. Nos. 4,515,888, 4,639,414, 4,713,316, 5,258,282 and 5,441,866.

Infra-red sensitizers according to general formula (I) are especially preferred for use in the photosensitive thermally developable photographic material used in the present invention:

with an anion if necessary for charge compensation, wherein $Z^1$ and $Z^2$ independently represent S, O or Se; $R^1$ and $R^{13}$ independently represent an alkylene group; $X^1$ and $X^2$ independently represent a —(C=O)—$R^{18}$, a —($SO_2$)—$R^{19}$ or a —(S=O)—$R^{20}$ group where $R^{18}$, $R^{19}$ and $R^{20}$ independently represent an alkoxy-, aryloxy- or amino-group; $R^2$, $R^3$, $R^4$, $R^5$, $R^{14}$, $R^{15}$, $R^{16}$ and $R^{17}$ independently represent hydrogen, chlorine, bromine, fluorine, iodine or a keto-, sulfo-, carboxy-, ester-, sulfonamide-, amide-, dialkylamino-, nitro-, cyano-, alkyl-, alkenyl-, heteroaromatic, aryl-, alkoxy- or aryloxy-group; or each of $R^2$ together with $R^3$, $R^3$ together with $R^4$, $R^4$ together with $R^5$, $R^{14}$ together with $R^{15}$, $R^{15}$ together with $R^{16}$ and $R^{16}$ together with $R^{17}$ may independently constitute the atoms necessary to complete a benzene ring; $R^6$, $R^7$, $R^8$, $R^9$, $R^{10}$, $R^{11}$ and $R^{12}$ independently represent hydrogen, chlorine, bromine, fluorine, iodine, an alkyl group, an alkoxy group, an aryloxy group, a thioalkyl group, a disubstituted amino group, where the substituents may constitute the atoms necessary to complete a 5-ring atom or 6-ring atom heterocyclic ring, or each of $R^6$ together with $R^8$, $R^8$ together with $R^{10}$, $R^{10}$ together with $R^{12}$, $R^7$ together with $R^9$ and $R^9$ together with $R^{11}$ may independently constitute the atoms necessary to complete a 5-atom or 6-atom carbocylic or heterocyclic ring; and each of $R^1$ together with $R^6$ and $R^{13}$ together with $R^{12}$ may independently constitute the atoms necessary to complete a 5-ring atom or 6-ring atom heterocyclic ring. In the general formula (I) the substituted amino group represented by the $R^{18}$, $R^{19}$ and $R^{20}$ groups may be all possible substitutions of the amino group, including thereby, —NH—(C=O)—$R^{21}$, —NH—($SO_2$)—$R^{22}$, —NH—(S=O)—$R^{23}$, —$N^-$—CN, —$N^-$—(C=O)—$R^{24}$, —$N^-$—($SO_2$)—$R^{25}$, —$N^-$—(S=O)—$R^{26}$ and —$N^-$—CN groups where $R^{21}$, $R^{22}$, $R^{23}$, $R^{24}$, $R^{25}$ and $R^{26}$ independently represent an alkyl or an aryl group.

In particularly preferred dyes corresponding to general formula (I), used according to the present invention, $R^{18}$, $R^{19}$ and $R^{20}$ independently represent a —NH—(C=O)—$R^{21}$, —NH—($SO_2$)—$R^{22}$, —NH—(S=O)—$R^{23}$ or a —NH—CN group which may be deprotonated, where $R^{21}$, $R^{22}$ and $R^{23}$ independently represent an alkyl or an aryl group.

Any substituents, carbocyclic rings and heterocyclic rings according to general formula (I) may also be substituted.

IR-sensitizing dyes according to general formula (I) suitable for use according to the present invention are:

(I)

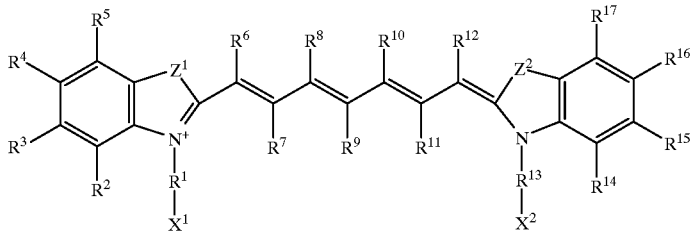

SENSI 01:
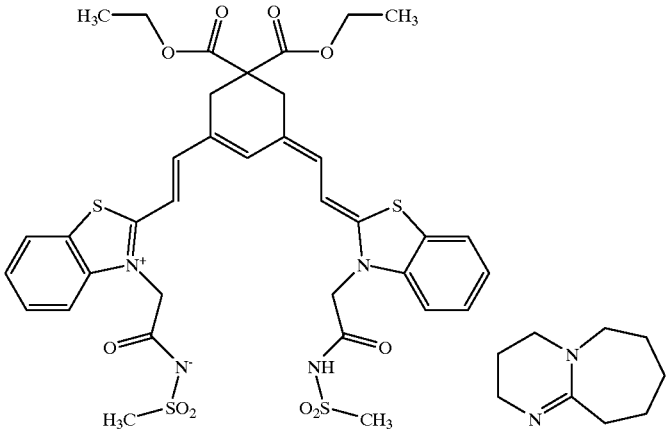
SENSI 02:
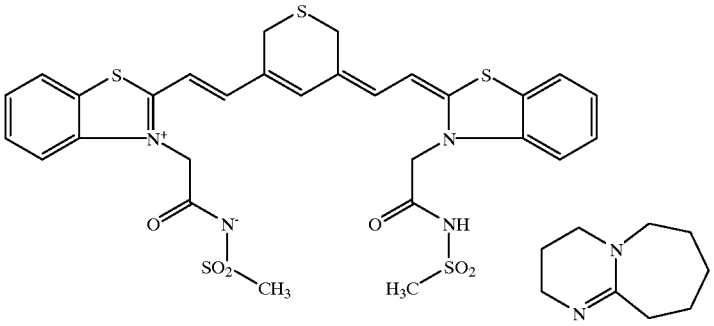
SENSI 03:
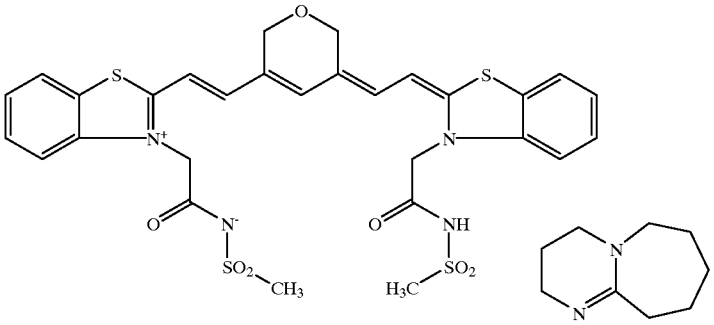
SENSI 04:
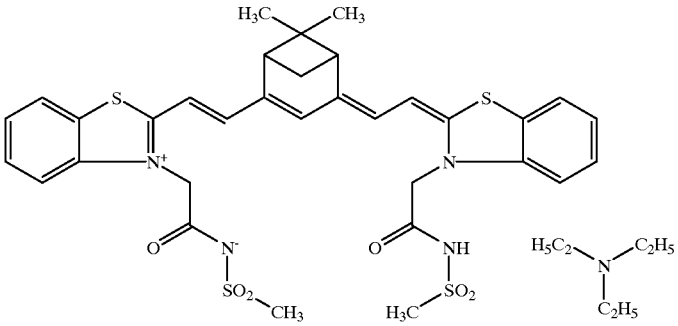

-continued
SENSI 05:
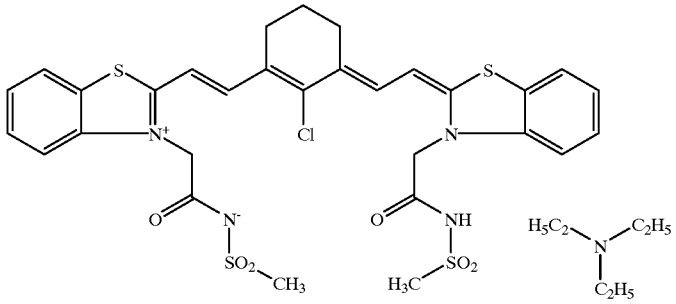
SENSI 06:
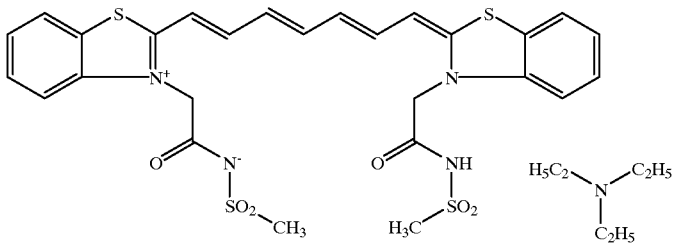
SENSI 07:
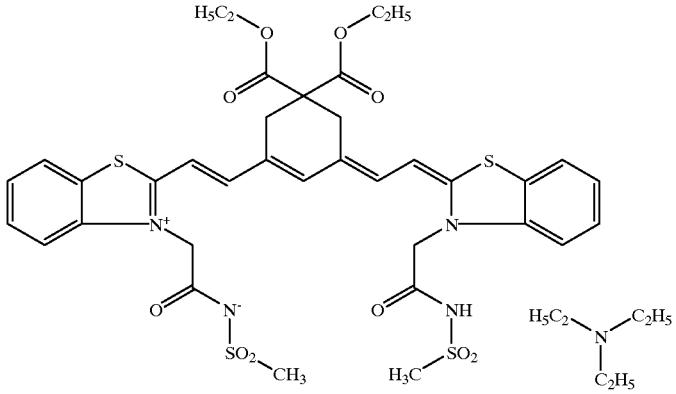
SENSI 08:
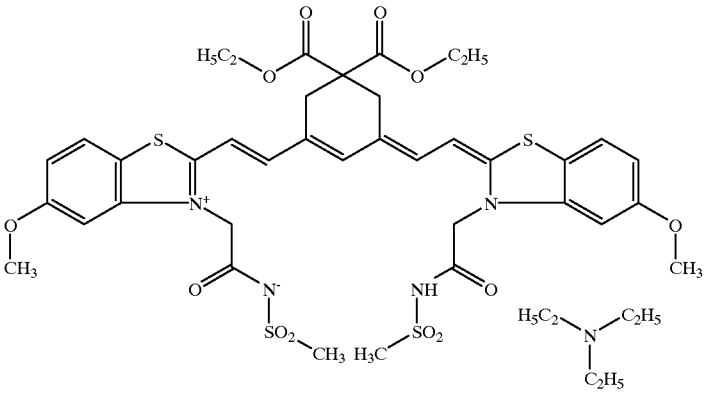

-continued

SENSI 09:

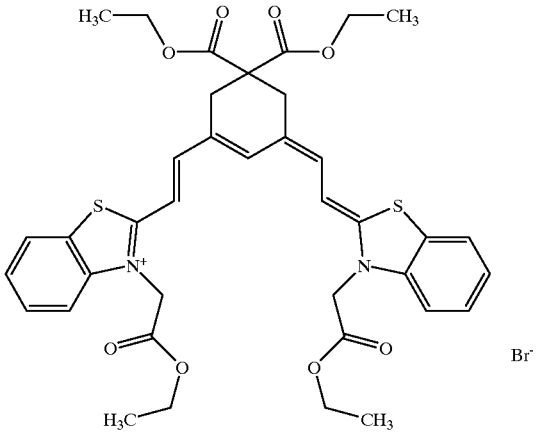

SENSI 10:

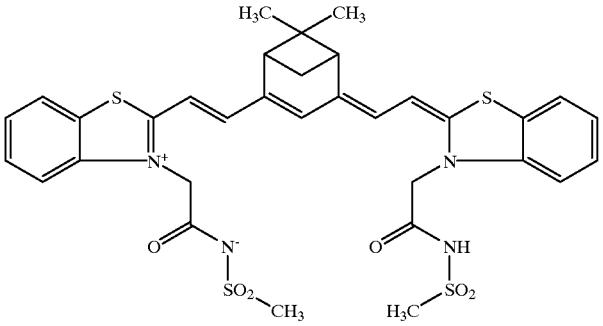

SENSI 11:

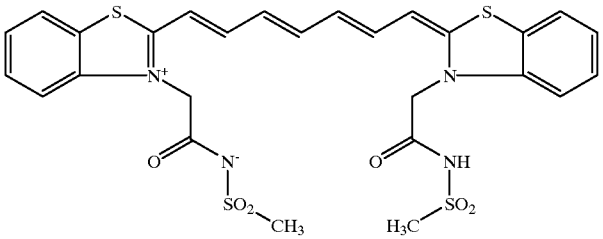

Supersensitizers

According to the present invention the photosensitive thermally developable photographic material further includes a supersensitizer. Preferred supersensitzers are selected from the group of compounds consisting of: mercapto-compounds, disulfide-compounds, stilbene compounds, organoborate compounds and styryl compounds. Suitable supersensitizers for use with infra-red spectral sensitizers are disclosed in EP-A 559 228, EP-A 587 338, U.S. Pat. No. 3,877,943, U.S. Pat. No. 4,873,184 and unpublished European Patent Application EP 96202107.7.

Substantially Light-Insensitive Organic Silver Salts

Preferred substantially light-insensitive organic silver salts used in the photosensitive thermally developable photographic material used in the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermosensitive silver image. Silver imidazolates and the substantially light-insensitive inorganic or organic silver salt complexes described in U.S. Pat. No. 4,260,677 are also suitable.

The term substantially light-insensitive organic silver salt for the purposes of the present invention also includes mixtures of organic silver salts.

Emulsion of Organic Silver Salt and Photosensitive Silver Halide

The silver halide may be added to the photosensitive thermally developable photographic material in any fashion which places it in catalytic proximity to the substantially light-insensitive organic silver salt. Photosensitive silver halide and substantially light-insensitive organic silver salt which are separately formed. i.e. ex-situ or "preformed", in a binder can be mixed prior to use to prepare a coating solution, but they may be blended for a long period of time prior to use. A particularly preferred mode of preparing the emulsion of organic silver salt and photosensitive silver halide for coating of the photosensitive thermally developable photographic material from solvent media, according to the present invention is that disclosed in U.S. Pat. No. 3,839,049, but other methods such as those described in Research Disclosure. June 1978, item 17029 and U.S. Pat. No. 3,700,458 may also be used.

Organic Reducing Agent

Suitable organic reducing agents for use in the photosensitive thermally developable photographic material used in the present invention are organic compounds containing at least one active hydrogen atom linked to O, N or C, such as is the case with, mono-, bis-, tris- or tetrakis-phenols; mono- or bis-naphthols; di- or polyhydroxy-naphthalenes; di- or polyhydroxybenzenes; hydroxymonoethers such as alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; 3-pyrazolines; pyrazolones; reducing saccharides; aminophenols e.g. METOL™; p-phenylenediamines, hydroxylamine derivatives such as for example described in U.S. Pat. No. 4,082,901; reductones e.g. ascorbic acids; hydroxamic acids; hydrazine derivatives; amidoximes; n-hydroxyureas; and the like, see also U.S. Pat. Nos. 3,074,809, 3,080,254, 3,094,417 and 3,887,378. Particularly preferred catechol-type reducing agents are described in EP-A 692 733 and EP-A 599 369.

Polyphenols such as the bisphenols used in the 3M Dry Silver™ materials, sulfonamide phenols such as used in the Kodak Dacomatic™ materials, and naphthols are particularly preferred for photosensitive thermally developable photographic materials on the basis of silver halide/organic silver salt/reducing agent.

Auxiliary Reducing Agents

The above mentioned reducing agents being considered as primary or main reducing agents may be used in conjunction with so-called auxiliary reducing agents. Auxiliary reducing agents that may be used in conjunction with the above-mentioned primary reducing agents are sulfonamidophenols as described in the periodical Research Disclosure, February 1979, item 17842, in U.S. Pat. Nos. 4,360,581 and 4,782,004, and in EP-A 423 891. Other auxiliary reducing agents that may be used in conjunction with the above mentioned primary reducing agents are hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; and organic reducing metal salts, e.g. stannous stearate described in U.S. Pat. Nos. 3,460,946 and 3,547,648.

Binder

The binder for the photosensitive thermally developable photographic material used in the present invention may be coatable from a solvent or aqueous dispersion and must themselves be film-forming or must be used in association with a film-forming binder.

Film-forming binders coatable from a solvent dispersion and usable in the present invention may be all kinds of natural, modified natural or synthetic resins or mixtures of such resins, wherein the organic silver salt can be dispersed homogeneously: e.g. polyurethanes, polyesters, polyamides, polycarbonates and polymers derived from α,β-ethylenically unsaturated compounds, polyvinyl acetals preferably polyvinylbutyral, and homopolymers and copolymers produced using monomers selected from the group consisting of: acrylonitrile, acrylamides, methacrylamides, methacrylates, acrylates, methacrylic acids, acrylic acids, vinyl esters, styrenes and alkenes; or mixtures thereof.

The film-forming binder coatable from an aqueous dispersion used in the present invention may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives; cellulose derivatives; polysaccharides; galactomannan; polyvinyl alcohol; polyvinylpyrrolidone; polyurethanes; polyesters; polyamides; polycarbonates; polymers derived from α,β-ethylenically unsaturated compounds, for example polyvinyl acetals, preferably polyvinylbutyral, and homopolymers and copolymers produced using monomers selected from the group consisting of: acrylonitrile, acrylamides, methacrylamides, methacrylates, acrylates, methacrylic acids, acrylic acids, vinyl esters, styrenes and alkenes; and latexes of water dispersible polymers, with or without hydrophilic groups, or mixtures thereof.

The above-mentioned binders or mixtures thereof may be used in conjunction with waxes or "heat solvents" also called "thermal solvents" or "thermosolvents" improving the reaction speed of the redox-reaction at elevated temperature.

Polycarboxylic Acids and Anhydrides Thereof

The photosensitive thermally developable photographic material used according to the present invention may also contain at least one polycarboxylic acid and/or anhydride thereof in a molar percentage of at least 20 with respect to all the organic silver salt(s) present and in thermal working relationship therewith. Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Toning Agents

In order to obtain a neutral black image tone in the higher densities and neutral grey in the lower densities the photosensitive thermally developable photographic material preferably contains in admixture with the organic silver salts and reducing agents a so-called toning agent known from thermography or photothermography. Suitable toning agents are succinimide, phthalazine and the phthalimides and phthalazinones within the scope of the general formulae described in U.S. Pat. No. 4,082,901 and the toning agents described in U.S. Pat. Nos. 3,074,809, 3,446,648 and 3,844,797. Particularly useful toning agents are the heterocyclic toner compounds of the benzoxazine dione or naphthoxazine dione type as described in GB-P 1,439,478, U.S. Pat. Nos. 3,951,660 and 5,599,647.

Antihalation Dyes

In addition to the ingredients, the photosensitive thermally developable photographic materials used in the present invention may also contain antihalation or acutance dyes which absorb light which has passed through the photosensitive thermally developable photographic material, thereby preventing its reflection. Such dyes may be incorporated into the photosensitive thermally developable photographic material or in any other layer of the photographic material of the present invention.

Other Additives

In addition to the ingredients the photosensitive thermally developable photographic material used in the present invention may also contain additives such as free fatty acids, surface-active agents, silicone oil, e.g. BAYSILONE™ Ö1 A (from BAYER AG, GERMANY); ultraviolet light absorbing compounds; silica; colloidal silica; fine polymeric particles, e.g. of poly(methylmethacrylate); and/or optical brightening agents.

Support

The support for the photosensitive thermally developable photographic material used in the present invention may be transparent, translucent or opaque, e.g. having a white light reflecting aspect and is preferably a thin flexible carrier made e.g. from paper, polyethene coated paper or transparent resin material, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956.

The support may be in sheet, ribbon or web form and subbed if need be to improve the adherence to the thereon coated thermosensitive recording layer. One or more backing layers may be provided to control physical properties such as curl or static.

Protective Layer

The outermost layer of the side of the photosensitive thermally developable photographic material which is photosensitive may be a protective layer to avoid local deformation of the photosensitive thermally developable photographic material and to improve resistance against abrasion.

The protective layer preferably comprises a binder, which may be hydrophobic (solvent soluble) or hydrophilic (water soluble) e.g. as described in EP-A 614 769. Hydrophilic binders are, however, preferred for the protective layer, as coating can be performed from an aqueous composition and mixing of the hydrophilic protective layer with the immediate underlayer can be avoided by using a hydrophobic binder in the immediate underlayer.

A protective layer used in the present invention may also contain at least one solid lubricant having a melting point below 150° C. and at least one liquid lubricant at least one of these lubricants being a phosphoric acid derivative; and additional dissolved lubricating material and/or particulate material, e.g. talc particles, optionally protruding from the outermost layer. The lubricant may be applied with or without a polymeric binder.

Such protective layers may also contain particulate material, e.g. talc particles, optionally protruding from the protective outermost layer as described in WO 94/11198. Other additives can also be incorporated therein e.g. colloidal particles such as colloidal silica.

Antistatic Layer

The photosensitive thermally developable photographic materials used in the present invention may further include an antistatic layer. Suitable antistatic layers are described in EP-A's 444 326, 534 006 and 644 456, U.S. Pat. Nos. 5,364,752 and 5,472,832 and DOS 4125758. Particularly preferred antistatic layers are those based on polythiophene as disclosed in EP-A 628 560, U.S. Pat. Nos. 5,354,613, 5,372,924, 5,370,981 and 5,391,472.

Coating

The coating of any layer of the photosensitive thermally developable photographic materials used in the present invention may proceed by any thin-film coating technique known in the art. In the coating of web type supports for photographic materials slide hopper coating is preferred, but other coating techniques such as dip coating and air knife coating may also be used. Details about such coating techniques can be found in "Modern Coating and Drying Technology" by Edward D. Cohen and Edgar B. Gutoff, published by VCH Publishers, Inc. 220 East 23rd Street, Suite 909 New York, N.Y. 10010.

Industrial Application

The photosensitive thermally developable photographic materials used in the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the graphics hard copy field photosensitive thermally developable photographic materials on a white opaque base are used, whereas in the medical diagnostic field black-imaged transparencies are widely used in inspection techniques operating with a light box.

The following ingredients were used in the INVENTION & COMPARATIVE EXAMPLES of the present invention:

a) antihalation/antistatic layer ingredients:

D01:

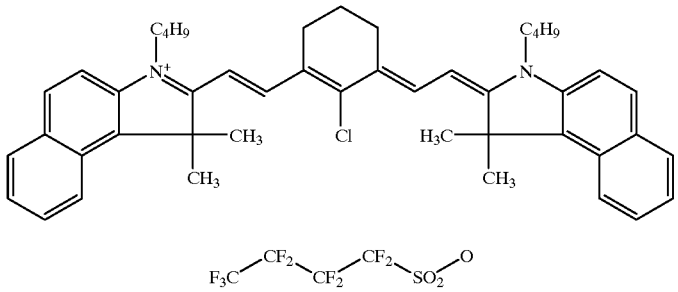

KELZAN™ S: a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PT-dispersion: a dispersion of poly(3,4-ethylenedioxythiophene)/polystyrene sulphonic acid produced by the polymerization of 3,4-ethylenedioxythiophene in the presence of polystyrene sulphonic acid and ferric sulphate as described in U.S. Pat. No. 5,354,613;

ULTRAVON™ W: an aryl sulfonate from CIBA-GEIGY;

PERAPRET™ PE40: a 40% aqueous dispersion of polyethylene wax from BASF;

KIESELSOL™ 100F: a 36% aqueous dispersion of colloidal silica from BAYER;

MAT01: 20% aqueous dispersion of particles of methylmethacrylate(98% by weight)-stearylmethacrylate (2% by weight)-copolymeric beads with an average particle size of 5.9 μm as described in U.S. Pat. No. 4,861,812;

LATEX01: a 12% by weight dispersion of polymethylmethacrylate with an average particle size of 88.8 nm as described in U.S. Pat. No. 5,354,613;

b) photosensitive layer:

i) silver behenate/silver halide emulsion layer:

GEL: phthaloylgelatin, type 16875 from ROUSSELOT;

Butvar™ B76: polyvinylbutyral from MONSANTO;

LOWINOX™ 22IB46: 2-propyl-bis(2-hydroxy-3,5-dimethylphenyl)methane from CHEM. WERKE LOWI;

TMABP: tetramethylammonium bromide perbromide;

TMPS: tribromomethyl benzenesulfinate;

MBI: 2-mercaptobenzimidazole;

SENSI: SENSI 01 ii) protective layer:

CAB: cellulose acetate butyrate, CAB-171-15S from EASTMAN;

PMMA: polymethylmethacrylate, Acryloid™ K120N from ROHM & HAAS.

LOWINOX™ 22IB46: 2-propyl-bis(2-hydroxy-3,5-dimethylphenyl)methane from CHEM. WERKE LOWI;

The following examples illustrate the present invention without however limiting it thereto. All percentages, parts and ratios are by weight unless otherwise mentioned.

COMPARATIVE EXAMPLE 1 & INVENTION EXAMPLES 1 TO 4

Photosensitive Thermally Developable Photographic Materials

Support

A polyethylene terephthalate (PET) foil pigmented with a blue pigment was first coated on both sides with a subbing layer consisting of a terpolymer latex of vinylidene chloride-methyl acrylate-itaconic acid (88/10/2) in admixture with colloidal silica (surface area 100 $m^2/g$). After stretching the foil in the transverse direction the foil had a thickness of 175 μm with coverages of the terpolymer and of the silica in the subbing layers of 170 $mg/m^2$ and 40 $mg/m^2$ respectively on each side of the PET-foil.

Antihalation/Antistatic Layer

The antihalation/antistatic layer was prepared by first adsorbing antihalation dye D01 onto the polymethyl methacrylate particles of LATEX01 by adding 55 mg of D01 dissolved in ethyl acetate/g polymethyl methacrylate and then evaporating off the ethyl acetate.

One side of the thus subbed PET-foil was then coated with an antistatic composition obtained by dissolving 0.30 g of KELZAN™ S in a stirred mixture of 22.4 mL of N-methylpyrrolidone, 0.84 g of ULTRAVON™ W, 1 g of PERAPRE™ PE40 and 2.22 g of KIESELSOL 100F in 74.3 mL of deionized water and then adding with stirring: 0.2 mL of 25% $NH_4OH$, 0.6 g of dried PT-dispersion, 66.7 mL of LATEX01 after adsorption of D01, 1.2 mL of MAT01 and 30 mL of 2-propanol to produce a layer after drying at 120° C. consisting of:

KELZAN™ S: 7.5 $mg/m^2$
Dried PT-dispersion: 15 $mg/m^2$
ULTRAVON™ W: 21 $mg/m^2$
polyethylene wax (from PERAPRE™ PE40): 10 $mg/m^2$
colloidal silica (from KIESELSOL™ 100F): 20 $mg/m^2$
5.9 μm beads of crosslinked methylmethacrylate-stearylmethacrylate copolymer (from MAT01): 6 $mg/m^2$
polymethylmethacrylate (from LATEX01): 200 $mg/m^2$
Antihalation dye DO1: 11 $mg/m^2$

Silver Halide Emulsion

A silver halide emulsion consisting of 3.11% by weight of silver halide particles consisting of 97 mol % silver bromide and 3 mol % silver iodide with a weight average particle size of 50 nm, 0.47% by weight of GEL as dispersing agent in deionized water was prepared using conventional silver halide preparation techniques such as described, for example, in T. H. James, "The Theory of the Photographic Process", Fourth Edition, Macmillan Publishing Co. Inc., New York (1977). Chapter 3, pages 88–104.

Silver Behenate/Silver Halide Emulsion

The silver behenate/silver halide emulsion was prepared by adding a solution of 6.8 kg of behenic acid in 67 L of 2-propanol at 65° C. to a 400 L vessel heated to maintain the temperature of the contents at 65° C., converting 96% of the behenic acid to sodium behenate by adding with stirring 76.8 L of 0.25M sodium hydroxide in deionized water, then adding with stirring 10.5 kg of the above-described silver halide emulsion at 40° C. and finally adding with stirring 48 L of a 0.4M solution of silver nitrate in deionized water. Upon completion of the addition of silver nitrate the contents of the vessel were allowed to cool and the precipitate filtered off, washed, slurried with water, filtered again and finally dried at 40° C. for 72 hours.

7 kg of the dried powder containing 9 mol % silver halide and 4 mol % behenic acid with respect to silver behenate were then dispersed in a solution of 700 g of Butvar™ B76 in 15.6 kg of 2-butanone using conventional dispersion techniques yielding a 33% by weight dispersion. 7.4 kg of 2-butanone were then added and the resulting dispersion homogenized in a microfluidizer. Finally 2.8 kg of Butvar™ B76 were added with stirring to produce a dispersion with 31% by weight of solids.

Coating and Drying of Silver Behenate/Silver Halide Emulsion Layer

The emulsion layer coating composition for the photosensitive thermally developable photographic material was prepared by adding the following solutions or liquids to 40.86 g of the above-mentioned silver behenate/silver halide emulsion in the following sequence with stirring: 10.87 g of 2-butanone, 0.75 g of a 9% solution of TMABP in methanol followed by 2 hours stirring, 1.3 g of 2-butanone, 0.2 g of a 11% solution of calcium bromide in methanol and 1.3 g of 2-butanone followed by 30 minutes stirring, a solution consisting of 0.21 g of LOWINOX™ 22IB46, 0.5 g of TMPS and 9.24 g of 2-butanone followed by 10 minutes stirring, 1.84 g of a 0.11% methanol solution of SENSI followed by 30 minutes stirring and finally 4.35 g of Butvar™ B76 were added followed by 45 minutes of stirring and then 4.79 g of 2-butanone.

The PET-support subbed and coated with an antihalation/antistatic layer as described above was then doctor blade-coated at a blade setting of 150 $\mu$m on the side of the support not coated with a backside layer with the coating composition to a wet layer thickness of 80 $\mu$m followed by drying for 5 minutes at 80° C. on an aluminium plate in a drying cupboard.

Protective Layer

A protective layer coating composition for the photosensitive thermally developable photographic material was prepared by dissolving 4.08 g of CAB and 0.16 g of PMMA in 36.3 g of 2-butanone and 4.16 g of methanol adding the following solids or solution with stirring in the following sequence: 0.5 g of phthalazine, 0.2 g of 4-methylphthalic acid, 0.1 g of tetrachlorophthalic acid, 0.2 g of tetrachlorophthalic acid anhydride and a solution consisting of 2.55 g of LOWINOX™ 22IB46 and 5.95 g 2-butanone. The emulsion layer was then doctor blade-coated at a blade setting of 100 $\mu$m with the protective layer coating composition to a wet layer thickness of 57 $\mu$m, which after drying for 8 minutes at 80° C. on an aluminium plate in a drying cupboard produced a layer with the following composition:

| | |
|---|---|
| CAB | 4.08 g/m$^2$ |
| PMMA | 0.16 g/m$^2$ |
| Phthalazine | 0.50 g/m$^2$ |
| 4-methylphthalic acid | 0.20 g/m$^2$ |
| tetrachlorophthalic acid | 0.10 g/m$^2$ |
| tetrachlorophthalic acid anhydride | 0.20 g/m$^2$ |
| LOWINOX ™ 22IB46 | 2.55 g/m$^2$ |

Information-Wise Exposure and Thermal Processing

Sheets of the photosensitive thermally developable photographic material were information-wise exposed and thermally developed in an apparatus in which information-wise exposure and thermal development took place on the same heatable drum 198 mm in diameter and the photosensitive thermally developable photographic material was transported at a speed of 20.73 mm/s with its antistatic/antihalation-layer in contact with the drum i.e. with the protective layer for the silver behenate/silver halide emulsion layer outermost. Information-wise exposure took place with a 200 mW laser diode from SDL at a speed of 20.73 mm/s at 10.85 lines/mm with a maximum laser intensity of 71 mW/spot (diameter 120 $\mu$m), each 355.6×431.8 mm$^2$ sheet requiring 20.8 s for exposure. Thermal development was carried out for 15 s at 121° C., the sheet being in contact with the heatable drum over 311.02 mm of the circumference thereof. For COMPARATIVE EXAMPLE 1, the sheet was neither heated before nor during exposure and for INVENTION EXAMPLES 1 to 4 the sheets were preheated via the drum for different times and heated during exposure.

The optical densities of the resulting images were measured in transmission with a MacBeth™ TR924 densitometer through a visible filter to produce a sensitometric curve for the photosensitive thermally developable photographic materials from which the maximum and minimum optical densities, $D_{max}$ and $D_{min}$, and the relative photosensitivities for $D_{min}$+1.0 determined.

The $D_{max}$- and $D_{min}$-values and the relative photosensitivity values to obtain an optical density of $D_{min}$+1.0 obtained upon information-wise exposure and thermal processing of the photosensitive thermally developable photographic material together with the preheating conditions and thermal processing conditions used are summarized in table 1.

TABLE 1

| | preheating | | thermal processing conditions | | | | Relative photo-sensitivity |
|---|---|---|---|---|---|---|---|
| | temp-erature [° C.] | time [s] | temp-erature [° C.] | time [s] | $D_{max}$ | $D_{min}$ | at $D_{min}$ + 1.0 [J/m$^2$] |
| Comparative example number 1 | — | — | 121 | 15 | 2.34 | 0.32 | 1.05 |
| Invention example number | | | | | | | |
| 1 | 121 | 0.52 | 121 | 15 | 2.50 | 0.32 | 0.92 |
| 2 | 121 | 1.56 | 121 | 15 | 2.56 | 0.32 | 0.71 |
| 3 | 121 | 2.60 | 121 | 15 | 2.78 | 0.32 | 0.71 |
| 4 | 121 | 3.64 | 121 | 15 | 3.00 | 0.32 | 0.52 |

A comparison of the photosensitivities attained upon heating during exposure with different preheating conditions compared with the results obtained with the COMPARATIVE EXAMPLE 1 for which exposure took place with a cold material and no preheating was carried out show a pronounced increase in $D_{max}$ for the same exposure and a significant increase in photosensitivity. Furthermore, this increase in photosensitivity was achieved with exposure taking place during heating with the photsensitive thermally developable photographic material on one and the same holding or guiding means, in this instance a drum, thereby enabling a more compact processing unit to be used.

COMPARATIVE EXAMPLE 2 & INVENTION EXAMPLE 5

In INVENTION EXAMPLE 5 DRYVIEW™ photosensitive thermally developable photographic material from IMATION was used instead of the photosensitive thermally developable photographic material of COMPARATIVE EXAMPLE 1 and INVENTION EXAMPLES 1 to 4. The DRYVIEW™ material is based on a conventional silver halide/silver behenate/reducing agent concept and is spectrally sensitized to infra-red radiation. Information-wise exposure and thermal processing were carried out using the apparatus used for COMPARATIVE EXAMPLE 1 and INVENTION EXAMPLES 1 to 4 with thermal development carried out at 123.9° C. for 17.5 s instead of for 15 s at 121° C.

The $D_{max}$- and $D_{min}$-values and the relative photosensitivity values to obtain an optical density of $D_{min}$+1.0 obtained upon information-wise exposure and thermal processing of the photosensitive thermally developable photographic material together with the preheating conditions and thermal processing conditions used are summarized in table 2.

TABLE 2

| | preheating | | thermal processing conditions | | | | Relative photo-sensitivity |
|---|---|---|---|---|---|---|---|
| | temp-erature [° C.] | time [s] | temp-erature [° C.] | time [s] | $D_{max}$ | $D_{min}$ | at $D_{min}$ + 1.0 [J/m$^2$] |
| Comparative example number 2 | — | — | 123.9 | 17.5 | 2.93 | 0.26 | 0.67 |
| Invention example number 5 | 123.9 | 0.52 | 123.9 | 17.5 | 3.07 | 0.26 | 0.57 |

A comparison of the photosensitivities attained upon heating during exposure with preheating compared with the results obtained with the COMPARATIVE EXAMPLE 2 for which exposure took place with a cold material and no preheating was carried out show an increase in $D_{max}$ for the same exposure and an increase in photosensitivity. Again, this increase in photosensitivity was achieved with exposure taking place during heating with the photsensitive thermally developable photographic material on one and the same holding or guiding means, in this instance a drum, thereby enabling a more compact processing unit to be used.

Having described in detail preferred embodiments of the present invention, it will be now apparent to those skilled in the art that numerous modifications can be made therein without departing from the scope of the invention as defined in the following claims.

We claim:

1. A recording process comprising the steps of: information-wise exposing to radiation a single sheet of photographic material which comprises a photosensitive, thermally developable photographic material consisting essentially of a photosensitive silver halide, an organic reducing agent and a binder thereby producing a latent image therein; and heating said single sheet of photosensitive, thermally developable photographic material with a heating means; wherein said heating means is heated to a development temperature; wherein said single sheet of photosensitive, thermally developable photographic material is on one and the same holding or guiding means during both said information-wise exposure step and said heating step; wherein said information-wise exposure step is carried out during said heating step; and wherein any heating subsequent to exposure is carried with said same heating means heated to said development temperature.

2. Recording process according to claim 1, wherein said exposure step begins after the start of said heating step.

3. Recording process according to claim 1, wherein said information-wise exposure step and thermal development of said photosensitive thermally developable photographic material are carried out during said heating step.

4. Recording process according to claim 1, wherein the duration of said exposure step is less than one tenth of the duration of said heating step.

5. Recording process according to claim 1, wherein the duration of said exposure step is less than one hundredth of the duration of said heating step.

6. Recording process according to claim 1, wherein said recording process further comprises the step of preheating said photographic material prior to exposure.

7. Recording process according to claim 1, wherein said photosensitive thermally developable photographic material contains an infra-red sensitizer.

8. Recording process according to claim 7, wherein said infra-red sensitizer is represented by general formula (I):

(I)

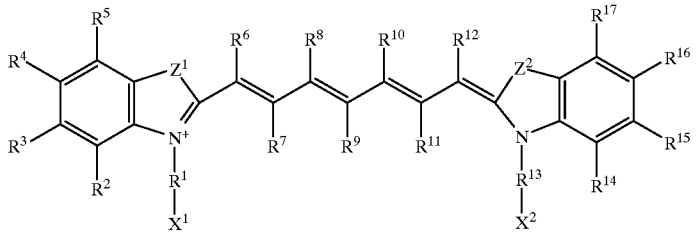

with an anion if necessary for charge compensation, wherein $Z^1$ and $Z^2$ independently represent S, O or Se: $R^1$ and $R^{13}$ independently represent an alkylene group; $X^1$ and $X^2$ independently represent a —(C═O)—$R^{18}$, a —($SO_2$)—$R^{19}$ or a —(S═O)—$R^{20}$ group where $R^{18}$, $R^{19}$ and $R^{20}$ independently represent an alkoxy-, aryloxy- or amino-group; $R^2$, $R^3$, $R^4$, $R^5$, $R^{14}$, $R^{15}$, $R^{16}$ and $R^{17}$ independently represent hydrogen, chlorine, bromine, fluorine, iodine or a keto-, sulfo-, carboxy-, ester-, sulfonamide-, amide-, dialkylamino-, nitro-, cyano-, alkyl-, alkenyl-, heteroaromatic, aryl-, alkoxy- or aryloxy-group; or each of $R^2$ together with $R^3$, $R^3$ together with $R^4$, $R^4$ together with $R^5$, $R^{14}$ together with $R^{15}$, $R^{15}$ together with $R^{16}$ and $R^{16}$ together with $R^{17}$ may independently constitute the atoms necessary to complete a benzene ring; $R^6$, $R^7$, $R^8$, $R^9$, $R^{10}$, $R^{11}$ and $R^{12}$ independently represent hydrogen, chlorine, bromine, fluorine, iodine, an alkyl group, an alkoxy group, an aryloxy group, a thioalkyl group, a disubstituted amino group, where the substituents may constitute the atoms necessary to complete a 5-ring atom or 6-ring atom heterocyclic ring, or each of $R^6$ together with $R^8$, $R^8$ together with $R^{10}$, $R^{10}$ together with $R^{12}$ , $R^7$ together with $R^9$ and $R^9$ together with $R^{11}$ may independently constitute the atoms necessary to complete a 5-atom or 6-atom carbocylic or heterocyclic ring; and each of $R^1$ together with $R^6$ and $R^{13}$ together with $R^{12}$ may independently constitute the atoms necessary to complete a 5-ring atom or 6-ring atom heterocyclic ring.

9. Recording process according to claim 1, wherein said photosensitive thermally developable photographic material contains a visible light sensitizer.

10. The recording process according to claim 1 wherein the photosensitive, thermally developable photographic material further comprises one or more ingredients selected from the group consisting of a supersensitizer, an auxiliary reducing agent, thermosolvents, polycarboxylic acids, polycarboxylic acid anhydrides, toning agents, antihalation dyes, fatty acids, surface-active agents, silicone oil, ultraviolet light absorbing compounds, silica, colloidal silica, fine polymeric particles, optical brightening agents, tetramethylammonium bromide perbromide, tribromomethyl benzenesulfinate, and at least a second binder.

11. Recording process according to claim 1, wherein said photosensitive thermally developable photographic material further contains a substantially light-insensitive organic silver salt.

12. A recording process comprising the steps of: information-wise exposing to radiation a photosensitive, thermally developable photographic material comprising a photosensitive silver halide, an organic reducing agent and a binder, thereby producing a latent image therein, and heating said photosensitive, thermally developable photographic material with a heating means; wherein said photosensitive, thermally developable photographic material is on one and the same holding or guiding means during both said information-wise exposure step and said heating step; wherein said information-wise exposure step is carried out during said heating step; wherein any heating subsequent to exposure is carried out with same heating means; and wherein at least two radiation beams move simultaneously over said photosensitive thermally developable photographic material the first of said radiation beams carrying out said information-wise exposing of said photosensitive, thermally developable photographic material and the second of which heats said information-wise exposed photosensitive, thermally developable photographic material to a uniform development temperature.

13. A method of increasing the photosensitivity of a photographic material, which method comprises the steps of: information-wise exposing to radiation a single sheet of a photosensitive, thermally developable photographic material consisting essentially of a photosensitive silver halide, an organic reducing agent, and a binder, thereby producing a latent image therein; and heating said single sheet of photosensitive thermally developable photographic material with a heating means; wherein said heating means is heated to a development temperature; wherein said single sheet of photosensitive thermally developable photographic material is on one and the same holding or guiding means during both said information-wise exposure step and said heating step; wherein said information-wise step is carried out during said heating step; and wherein any heating subsequent to exposure is carried out with said same heating means heated to said development temperature.

* * * * *

UNITED STATES PATENT AND TRADEMARK OFFICE

CERTIFICATE OF CORRECTION

PATENT NO. : 5,968,714

DATED : October 19, 1999

INVENTOR(S) : Leenders et al.

It is certified that error appears in the above-identified patent and that said Letters Patent is hereby corrected as shown below:

Column 11, formula SENSI 11: "Supersensitizers" is not part of the formula in which it appears (SENSI 11), and should be moved in order to serve as a heading for the following text (line 48);

Column 22, line 36: "photographic material which comprises" should be deleted.

Signed and Sealed this

Tenth Day of April, 2001

*Attest:*

Nicholas P. Godici

NICHOLAS P. GODICI

*Attesting Officer*

*Acting Director of the United States Patent and Trademark Office*